US010801304B2

(12) United States Patent
Hughes et al.

(10) Patent No.: US 10,801,304 B2
(45) Date of Patent: Oct. 13, 2020

(54) SYSTEMS AND METHODS FOR MULTI-STAGE WELL STIMULATION

(71) Applicant: The WellBoss Company, Inc., Calgary (CA)

(72) Inventors: John Hughes, Calgary (CA); Ryan D. Rasmussen, Calgary (CA); Colin Atkinson, Calgary (CA); Chad Michael Erick Gibson, Bragg Creek (CA)

(73) Assignee: The WellBoss Company, Inc. (CA)

( * ) Notice: Subject to any disclaimer, the term of this patent is extended or adjusted under 35 U.S.C. 154(b) by 0 days.

(21) Appl. No.: 16/580,872

(22) Filed: Sep. 24, 2019

(65) Prior Publication Data

US 2020/0095855 A1 Mar. 26, 2020

Related U.S. Application Data

(60) Provisional application No. 62/735,537, filed on Sep. 24, 2018.

(51) Int. Cl.
*E21B 34/14* (2006.01)
*E21B 43/14* (2006.01)
(Continued)

(52) U.S. Cl.
CPC ..... *E21B 34/142* (2020.05); *E21B 23/10* (2013.01); *E21B 34/14* (2013.01); *E21B 43/14* (2013.01);
(Continued)

(58) Field of Classification Search
CPC ..... E21B 34/14; E21B 23/04; E21B 23/10; E21B 43/14; E21B 2200/06; E21B 43/10; E21B 34/142; E21B 43/26
See application file for complete search history.

(56) References Cited

U.S. PATENT DOCUMENTS 8,672,036 B2 3/2014 Hughes et al.
8,863,853 B1 * 10/2014 Harris ..... E21B 23/004 166/386
(Continued)

*Primary Examiner* — Nicole Coy
(74) *Attorney, Agent, or Firm* — Rao DeBoer Osterrieder, PLLC; John M. DeBoer

(57) ABSTRACT

A system is provided, run on a liner, for stimulating one or more stages of a downhole wellbore. The system includes one or more frac valves arranged on the liner; each of the frac valves presenting an identical inside profile, the frac valves being openable for providing fluid communication between in inside of the liner to outside of the wellbore; and at least one dart deployable into the liner, and being adjustable to pass through one or more frac valves without opening said one or more frac valves, and to engage and open one or more other frac valves. Each of the at least one darts is identical to another. A method is further provided for stimulating one or more stages of a downhole wellbore. The method includes the steps of running a liner down the wellbore, the liner comprising one or more frac valves, each of the frac valves being openable to prove fluid communication between an inside of the liner to outside of the wellbore; pumping at least one dart down into the liner, passing said at least one dart through one or more frac valves without opening them; and engaging the at least one dart within and opening one or more other frac valves. Each of the at least one darts is identical to one another.

24 Claims, 12 Drawing Sheets

(51) Int. Cl.
*E21B 23/10* (2006.01)
*E21B 43/26* (2006.01)
*E21B 43/08* (2006.01)

(52) U.S. Cl.
CPC ..... *E21B 43/08* (2013.01); *E21B 43/261* (2013.01); *E21B 2200/06* (2020.05)

(56) References Cited

U.S. PATENT DOCUMENTS

| | | | | |
|---|---|---|---|---|
| 9,441,467 | B2 * | 9/2016 | Harris | E21B 23/004 |
| 9,500,063 | B2 | 11/2016 | Greenan | |
| 9,556,714 | B2 | 1/2017 | Hughes et al. | |
| 9,995,111 | B2 | 6/2018 | Hughes et al. | |
| 10,100,612 | B2 * | 10/2018 | Lisowski | E21B 17/046 |
| 10,156,124 | B2 | 12/2018 | Guzman et al. | |
| 10,294,748 | B2 * | 5/2019 | Barbato | E21B 34/14 |
| 2013/0025868 | A1 * | 1/2013 | Smith | E21B 34/14 166/308.1 |
| 2013/0299200 | A1 | 11/2013 | Hughes et al. | |
| 2014/0238689 | A1 | 8/2014 | Hughes et al. | |
| 2015/0114718 | A1 | 4/2015 | Hughes et al. | |
| 2015/0330185 | A1 | 11/2015 | Hughes et al. | |
| 2016/0298404 | A1 | 10/2016 | Beckett et al. | |
| 2016/0362957 | A1 * | 12/2016 | Barbato | E21B 34/14 |
| 2017/0051574 | A1 | 2/2017 | Hughes et al. | |
| 2017/0175488 | A1 * | 6/2017 | Lisowski | E21B 43/267 |
| 2017/0204700 | A1 | 7/2017 | Hughes et al. | |
| 2018/0038221 | A1 | 2/2018 | Hughes et al. | |
| 2018/0238137 | A1 | 8/2018 | Hughes et al. | |
| 2018/0238142 | A1 | 8/2018 | Hughes et al. | |

* cited by examiner

SYSTEMS AND METHODS FOR MULTI-STAGE WELL STIMULATION

FIELD OF INVENTION

The present invention presents a system and methods for stimulating a formation in multiple stages while providing an operator with flexibility in the stages that are to be stimulated or isolated from stimulation.

BACKGROUND OF THE INVENTION

Downhole oil and gas production operations, and particularly those in multi-stage wells, require the stimulation and production of one or more zones of a hydrocarbon bearing formation. In many cases this is done by running a liner or casing string downhole, in which the liner or casing string comprises one or more downhole frac valves, including but not limited to ported sleeves or collars, at spaced intervals along the wellbore. The location of the frac valves is commonly set to align with the formation zones to be stimulated or produced. The valves must be manipulated in order to be opened or closed as required. In the case of multistage fracking, multiple frac valves are used in a sequential order to frac sections of the formation, typically starting at a toe end of the wellbore and moving progressively towards a heel end of the wellbore. It is crucial that the frac valves be triggered to open in the desired order and that they do not open earlier than desired.

In some instances, the liner is arranged with valves having seats of increasing inside diameter progressing from toe to heel. The valves are manipulated by pumping balls, plugs or darts having sequentially increasing outside diameters down the liner. The first ball, having the smallest outside diameter passes through all frac valves until it seats on the first valve seat, having the smallest inside diameter. When a ball lands on the seat, fluid pressure uphole of the ball forces the ball downhole and causes it to mechanically move a sleeve of the valve downhole to expose the ports of the frac valve. In this arrangement, each valve must be uniquely built with a specific seat size and must be arranged on the liner in a specific order. Additionally, a stock of balls of all sizes of diameter must always be maintained to be able to manipulate all of the unique valve seats.

In other cases, opening of the frac valve achieved by running a bottom hole assembly, also known as an intervention tool, down on a tubing string through the liner or casing string, locating in the frac valves to be manipulated and manipulating the valve by any number of means including use of mechanical force on the intervention tool, or by hydraulic pressure. However, the use of an intervention tool is not always desirable; the tubing on which the intervention tool is run presents a flow restriction within the liner and prevents the full bore fluid flow required within the liner to achieve the needed stimulation pressure.

US 2017/0175488 teaches an indexing mechanism on a dart for opening one or more valves in a liner. The indexing mechanism takes the form of a reciprocating sleeve formed on the dart. The reciprocating sleeve that moves with contact of every valve and the dart is then guided through a j-type slot until the indexing sleeve is in a position that it will engage and open a selected valve.

U.S. Pat. No. 9,683,419 teaches an electrical control module with sensors within the dart, the sensors detecting one or more contact points on the valve/sleeve to be opened.

US patent application 2015/0060076 teaches a ported tool 100 having a profile receiver set to match a profile receiver on a selective tool actuator having a matching profile key. Each ported tool has a profile receiver that is set to specific orientation that is different from all others, before being run downhole. The ported tools are in this sense in different configurations when run downhole.

CA 2,842,568 teaches that a sleeve of each frac valve in a liner system is provided with a groove of distinctive width to receive an outwardly biased member also with a distinctive width on a dart. The frac valves are arranged downhole so that sleeve grooves increase in width from heel to toe and darts with matching width biased members are deployed to actuate the desired sleeve. The patent also teaches an embodiment in which a dart can be disengaged from the designated sleeve and travel further downhole to actuate downhole sleeves.

However, a need still exists for simple but robust system in which identical frac valves can be run downhole and can be opened in any sequence by one or more darts.

There is therefore still a need for frac valve systems which does not necessarily require the use of an intervention tool or of unique frac valves and dedicated balls or plugs, but that can open one or more frac valves in any order desired, and also for systems that allow for repeatedly opening and closing one or more frac valves within the liner for varying purposes.

SUMMARY

A system is provided, run on a liner, for stimulating one or more stages of a downhole wellbore. The system comprises one or more frac valves arranged on the liner; each of said frac valves presenting an identical inside profile, said frac valves being openable for providing fluid communication between in inside of the liner to outside of the wellbore; and at least one dart deployable into the liner, and being adjustable to pass through one or more frac valves without opening said one or more frac valves, and to engage and open one or more other frac valves. Each of said at least one darts is identical to another.

A method is further provided for stimulating one or more stages of a downhole wellbore. The method includes the steps of running a liner down the wellbore, the liner comprising one or more frac valves, each of said frac valves presenting an identical inside profile and being openable to prove fluid communication between an inside of the liner to outside of the wellbore; pumping at least one dart down into the liner, passing said at least one dart through one or more frac valves without opening them; and engaging said at least one dart within and opening one or more other frac valves. Each of said at least one darts is identical to one another.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. The drawings depict only typical embodiments of the invention and are therefore not to be considered limiting of its scope. In the drawings.

Figure 1:
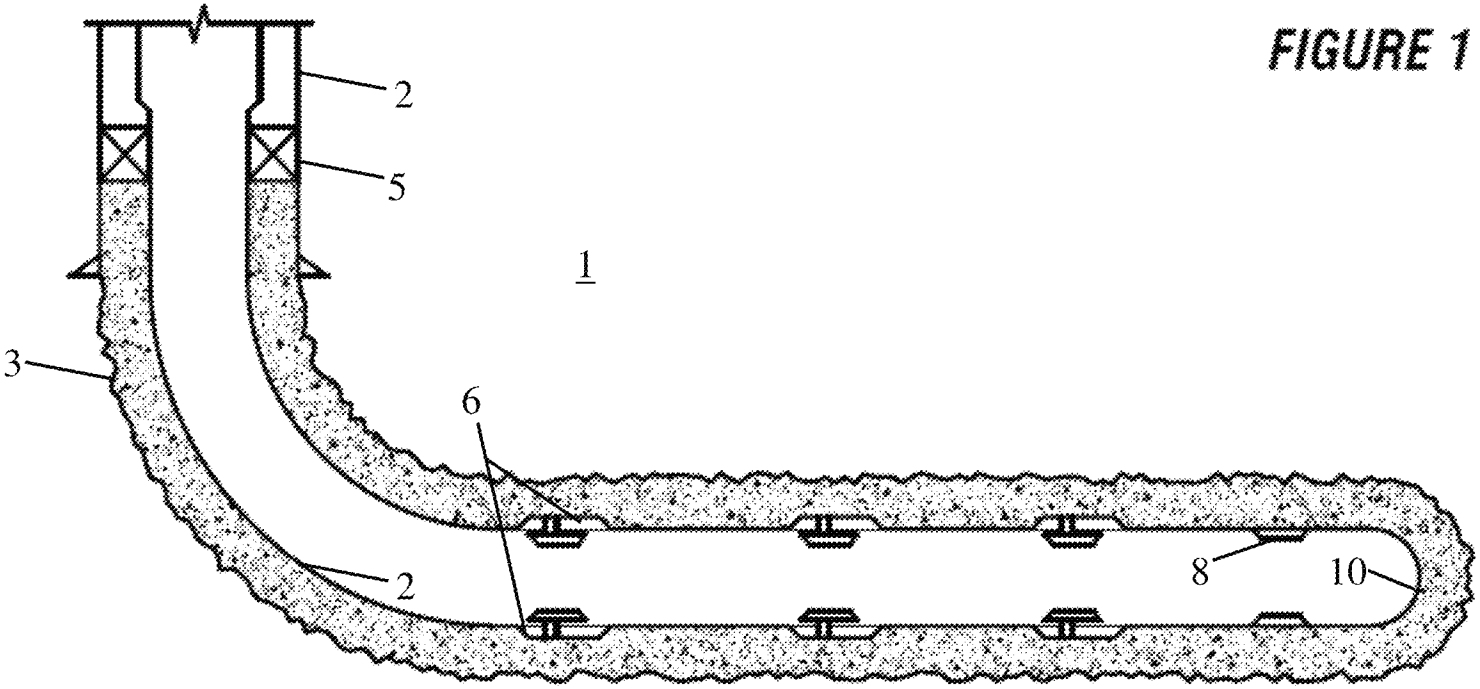
FIG. 1 is a cross sectional elevation view of a liner string carrying one example of the system of the present invention, run down a horizontal open wellbore and cemented in place.

The drawing is not necessarily to scale and in some instances proportions may have been exaggerated in order more clearly to depict certain features.

DETAILED DESCRIPTION OF VARIOUS EMBODIMENTS

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects.

The devices and systems described herein provide communication between an inside of a cased or lined wellbore and the surrounding rock formation. The reference to FIGS. 1 and 2, the casing or liner 2 may be cemented into the wellbore or packers 5 may be used to isolate sections of the casing or liner 2. It may also be possible that the wellbore is both cemented and having packers 5. The wellbore may be an open hole or a cased hole, or a hybrid thereof, with a portion cased and a portion open. The wellbore may be vertical, horizontal, deviated or of any orientation.

Multiple frac valves 6 can be installed along the length of the casing or liner string 2. While the term liner is used throughout the present description, it will be understood that both casing string and liner string are to be inferred.

Frac valves 6 are installed onto the liner 2 and strategically spaced along its length. The order in which the frac valves are installed does not matter as the frac valves are all identical and have identical bores.

Figure 2:
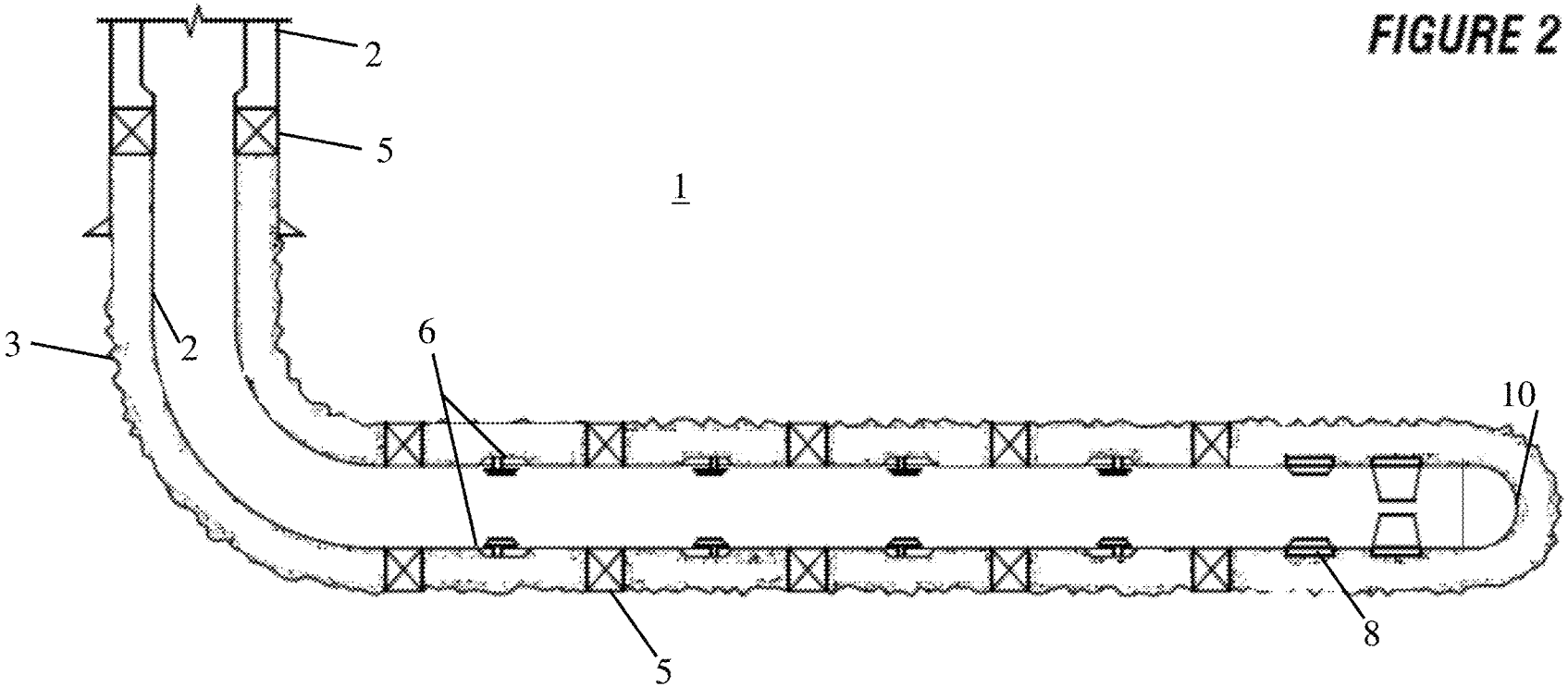
FIG. 2 is a cross sectional elevation view of a liner string carrying a further example of the system of the present invention, run down a horizontal open wellbore with packers isolating stages of the formation to be stimulated.

A toe valve 8 is placed near the lower, or toe end 10 of the liner 2. The liner is run into the well. Whenever the liner 2 has reached the bottom of the well it may be cemented into the formation using known cementing methods, as shown in FIG. 1. Alternatively it may be left in the borehole without cement. As seen in FIG. 2, open hole packers 5 installed on the liner 2 may be used to provide isolation along the length of the liner 2.

With reference to FIGS. 3 to 13, the present system is comprised of two main components; the frac valve 6 and a dart 14. The frac valve 6 is installed on the casing or liner 2, as mentioned before multiple frac valves can be spaced along the liner 2. The dart 14 is pumped down the inside diameter of the casing or liner 2. One or more darts 14 may be pumped down, depending on the number of stages of the formation to be stimulated.

Figure 3:
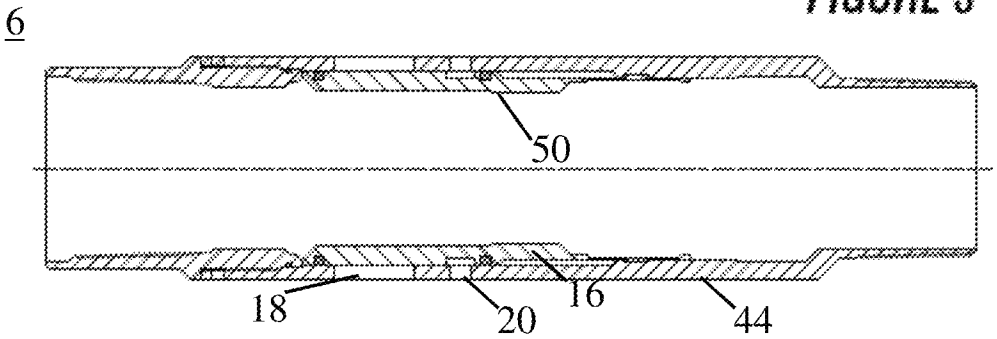
FIG. 3 is a cross sectional elevation view on one example of a frac valve of the present invention.

With reference now to FIG. 3, the frac valves 6 installed on the liner 2 are all identical. There is no need for differing valves with differing seat sizes. The frac valves 6 do not need to be installed in any particular order. They all have similar end connections and the outside diameter (O.D.) and inside profiles are all also the same. The valve seats 16 of each frac valve 6 all hold the same profiles. These seats 16 act as a shiftable sleeve to expose port 18 to allow for fluid communication between an inside of the liner 2 and formation surrounding it. For this reason, in some cases the valve seats 16 are also referred to as valve sleeves 16, but it is to be understood that these two terms encompass the same element. The opening pressure required to shift the seat 16 is adjustable by adjustment of shear screws 20 that hold the seat 16 to the frac valve 6 body. Commonly all frac valves 6 on a liner 2 can be installed with the same opening pressure or shear value.

Figure 4:
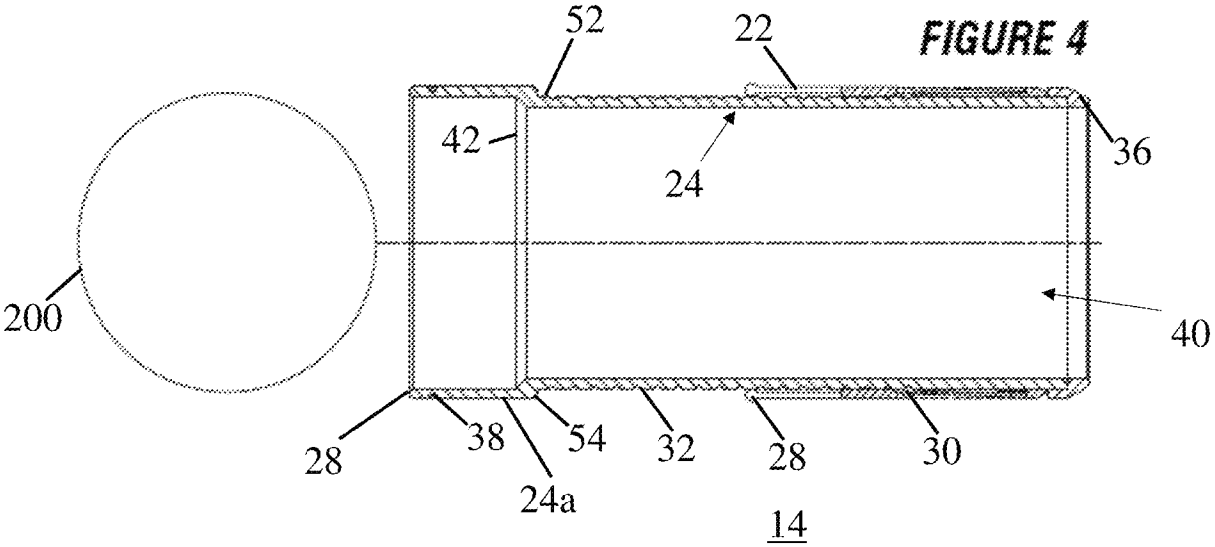
FIG. 4 is a cross sectional elevation view of one example of a dart of the present invention, with a corresponding ball.

With reference to FIG. 4, in one embodiment, the present dart 14 comprises an adjustment mechanism in the form of an indexing sleeve 22, a mandrel 24, and a cap 36. The indexing sleeve 22 defines an upper collet 28 and a lower collet 30. The cap 36 prevents the indexing sleeve 22 from unintentional shifting. Grooves 32 located circumferentially around the outside diameter of the mandrel 24 control the location of the indexing sleeve 22, as well as the position of the upper collet 28 and lower collet 30.

A bevel 42 on the upper edge of the mandrel 24 serves as an initial ball seat. A seal 38 on the upper outside diameter of the mandrel 24 acts as secondary sealing device while fracing is in process. The dart 14 is provided with a bore 40 through the centre of the mandrel 24 that provides passage for production fluid. The bore 40 large enough to present very little restriction to flow from the formation.

Both upper and lower collets 28, 32 are naturally biased radially inwardly. This bias helps to hold the indexing sleeve 22 in place on the mandrel 24. A ball 200 is used to pump the dart 14 into the well and act as a pressure barrier during fracing procedures.

With reference to FIGS. 6 to 9, the passing of the present dart 14 through one or more present frac valves 6 is now described. A dart 14, with a ball 200 resting on an uphole end of the mandrel 24 is pumped down into the liner 2. It would be well understood that while a ball 200 is shown in the figures, a plug or any other means of blocking flow through the bore of the dart 14 can be provided without departing from the scope of the present invention. For example, the uphole or downhole ends of the mandrel 24 can be closed by a permanent or detachable cover. By way of further example, the mandrel cap 36 can optionally take the form of a solid cap, rather than a ring, to block flow through the mandrel at the downhole end of the dart 14.

Although all of the frac valves 6 and darts 14 are identical, the distance between the indexing sleeve 22 and cap 36 on each dart varies. If the indexing sleeve 22 of a dart 14 is set to contact the cap 36, such a dart is set to travel past all other frac valves and land on and engage a frac valve 6 closest to the toe end 10 of the liner 2. As the indexing sleeve 22 location is set at incremental distances away from the cap 36, the particular dart 14 is set to land on and engage a subsequent frac valves after the frac valve closest to the toe end 10.

For example for illustrative purposes only, if the spacing between the indexing sleeve 22 and the cap 36 were to equal ¼", then such a dart 14 is set to pass all other frac valves and land on and engage the second frac valve from the toe 10. The length thus of the grooved 32 portion of the mandrel 24 of a dart is therefore set based on the number of frac valves 6 in a given liner. For example, the dart 14 illustrated in FIG. 4 can be used when there are eleven frac valves 6 in the liner 2. The length of the mandrel 24 and number of circumferential grooves 32 can be manufactured to suit the desired number of frac valves 6. Furthermore, the spacing between the grooves is not limited to ¼"; this distance is provided for illustrative purposes only. A spacer sleeve (not shown) can optionally also be used between the cap 36 and indexing sleeve 22 to ensure correct location of the indexing sleeve relative to the mandrel.

Figure 6:
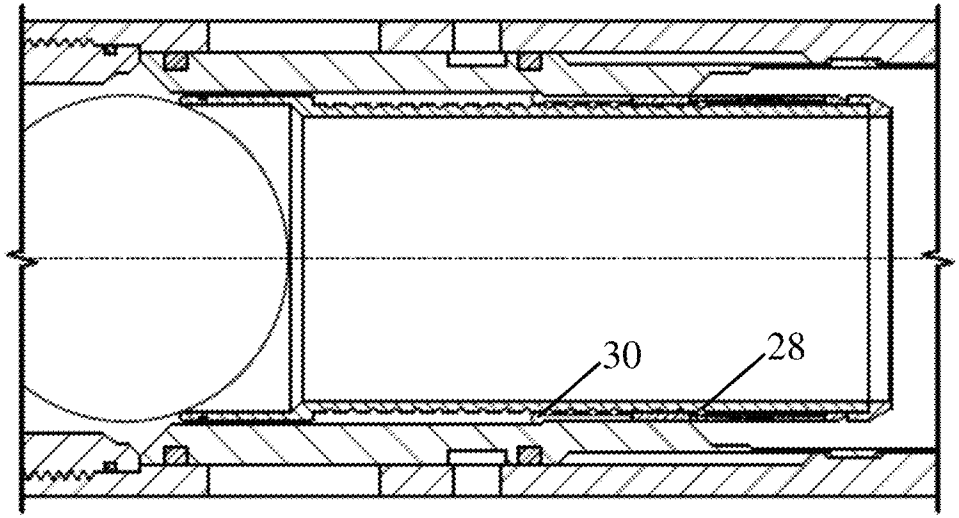
FIG. 6 is a cross sectional elevation view of the frac valve of FIG. 3 with the dart of FIG. 4 and a ball engaged there within, showing an upper collet of the dart in an extended position to engage a shoulder of the frac valve.

A dart 14 and ball 200 are deployed into the well and are pumped downhole until they contact a frac valve 6 closest to the heel 12 of the well. As seen in FIG. 6, the upper collet 28 on the indexing sleeve 22 lands on the shoulder 50 formed on the sliding sleeve 16 of the frac valve 6. In another option, the lower collet 30 cab be in a position to land on the shoulder 50 formed on the sliding sleeve 16. In this sense, it would be well understood by a person of skill in the art that although the below description refers to an initial positon in which the upper collet lands on shoulder 50, the initial position of the dart 14 in the frac valve 6 can vary.

Figure 7:
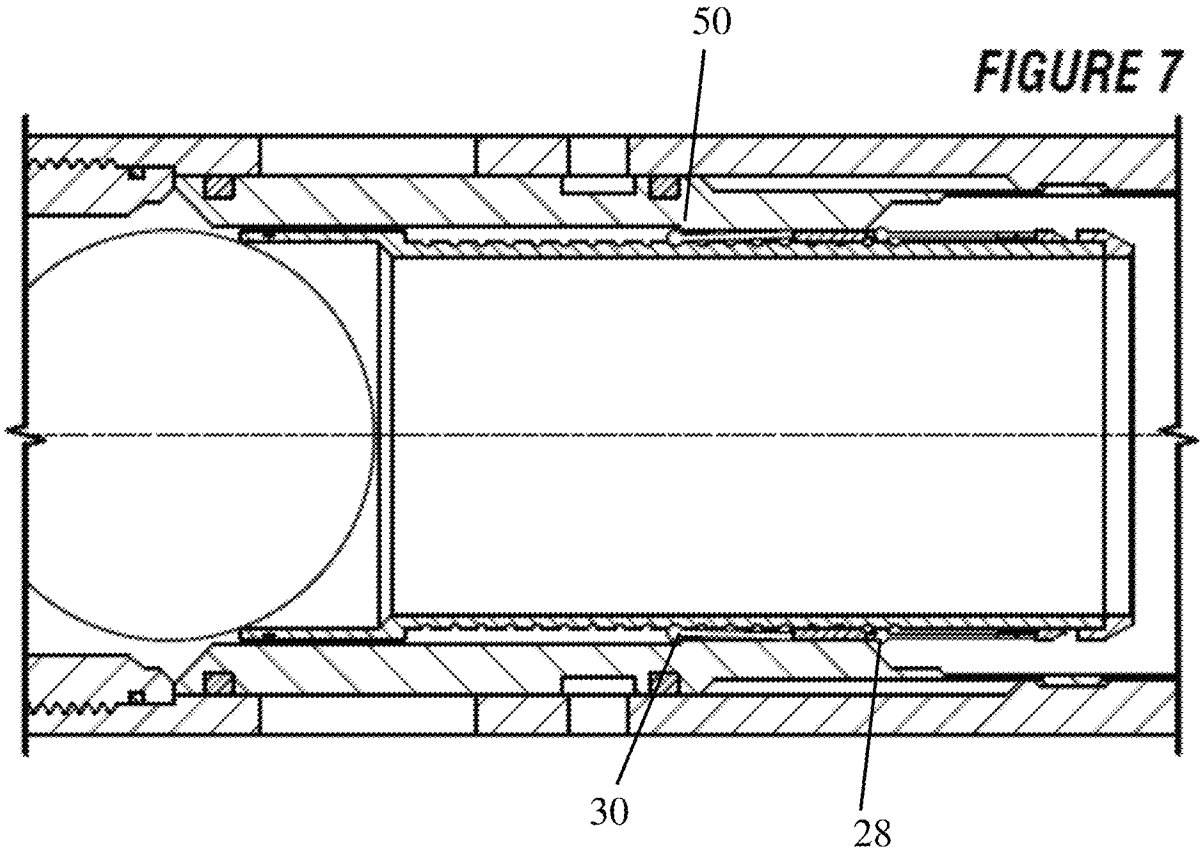
FIG. 7 is a cross sectional elevation view of the frac valve of FIG. 3 with the dart of FIG. 4 and a ball engaged there within, showing the lower collet in an extended position and the upper collet of the dart in a retraced position such that the dart can travel through the frac valve and downstream.

Pressure acting on the ball 200 generates a force on the mandrel 24 of the dart 14. When this force exceeds the force required to overcome the bias and express the lower collet 30 radially outwardly between two grooves 32, the upper collet 28 is radially retracted into an uphole subsequent circumferential groove 32 on the mandrel 24 and the mandrel is allowed to shift downhole relative to the indexing sleeve 22, as seen in FIG. 7.

Figure 8:
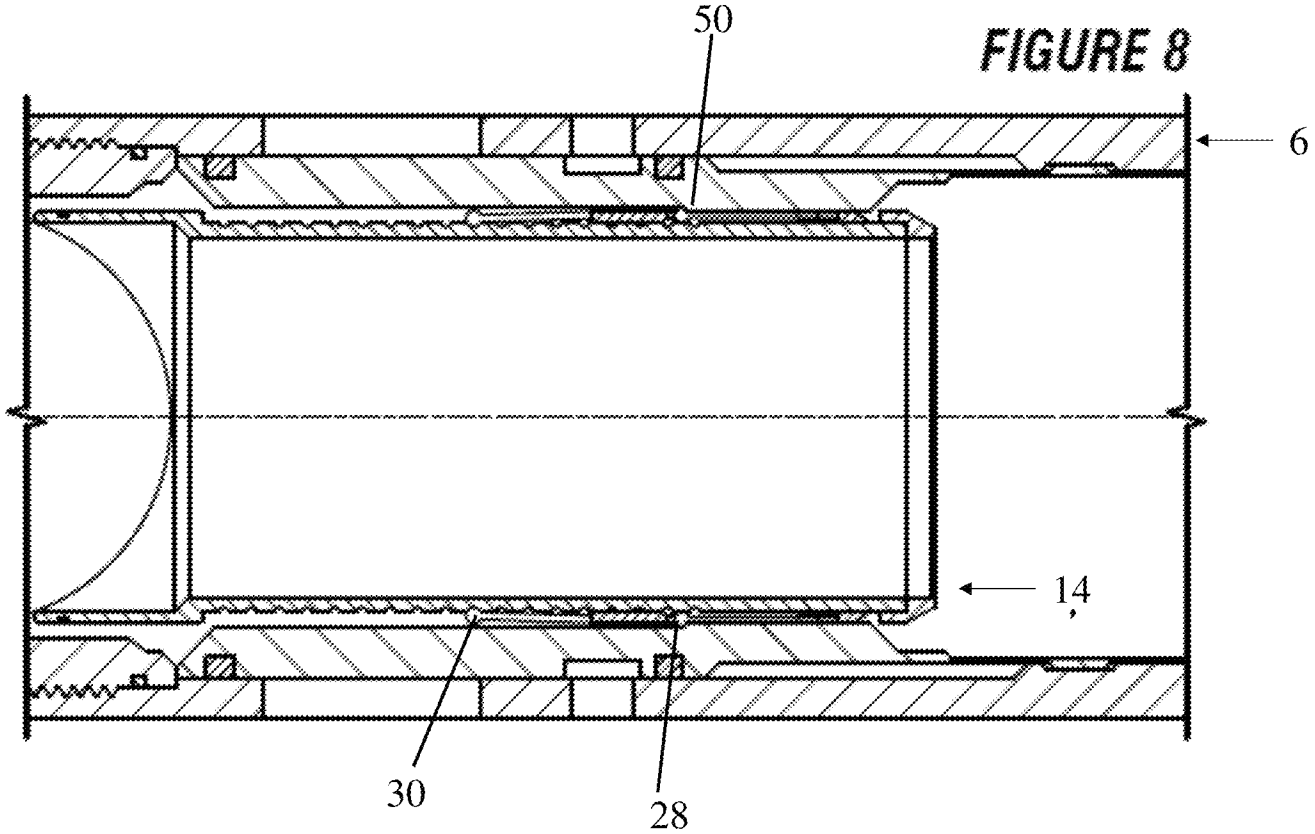
FIG. 8 is a cross sectional elevation view of a subsequent frac valve downstream to the frac valve of FIG. 7 with the dart of FIG. 4 and a ball engaged there within, showing the lower collet in an extended position engaged with a shoulder of the subsequent frac valve, and the upper collet of the dart in a retraced position.
Figure 9:
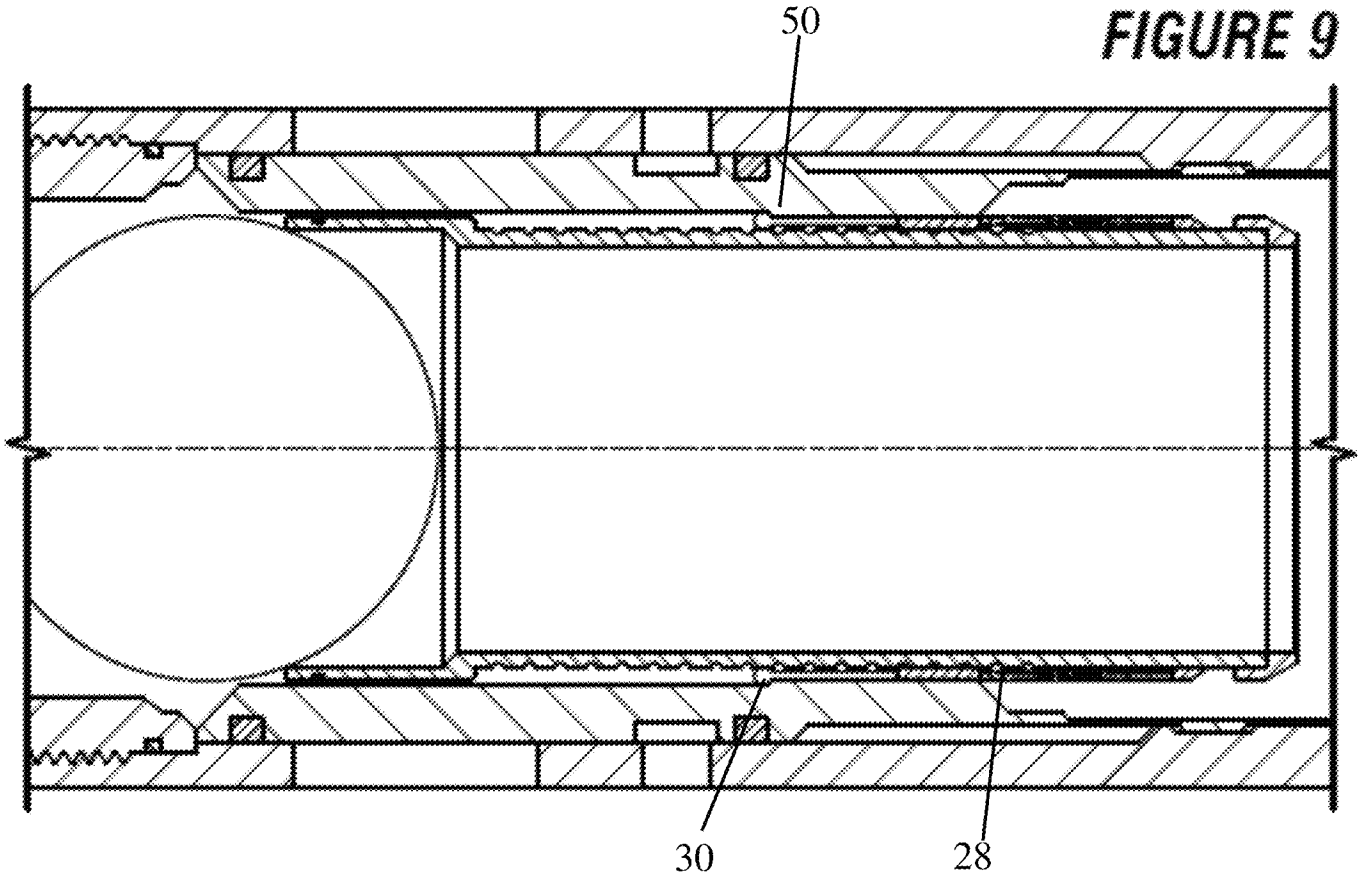
FIG. 9 is a cross sectional elevation view of the frac valve of FIG. 8 with the dart of FIG. 4 and a ball engaged there within, showing the lower collet now in a retracted positon and now having travelled downstream past the shoulder, and the upper collet of the dart in an extended position now engaging the shoulder.

With the upper collet 28 now radially retracted, the dart 14 is now free to travel downhole through the bore of the frac valve 6. The indexing sleeve 22 and mandrel 24 remain in this relative position until they reach the next frac valve 6 downhole in the liner 2. At this point, as illustrated in FIG. 8, the lower collet 30 is expressed radially outwardly and contacts the shoulder 50 of the sliding sleeve 16 within the frac valve 6. Again, pressure acting on the ball 200 generates a force on the mandrel 24 of the dart 14 and when this force exceeds the force required to overcome the bias and express the upper collet 28 radially outwardly, the mandrel 24 shifts dowhnhole relative to the indexing sleeve 22 and the lower collet 30 snaps into an uphole subsequent circumferential groove 32 on the mandrel 24. The dart 14 thus advances into the bore of the sliding sleeve 16 until the upper collet 28, which is now expressed radially outwardly, lands on the shoulder 50 of the sliding sleeve, as seen in FIG. 9.

This process repeats itself at each frac valve 6 along the liner 2 until the upper collet 28 of the indexing sleeve 22 lands on a restraint surface 52 on the mandrel 24 that expresses the upper collet 28 radially outwardly.

Figure 5:
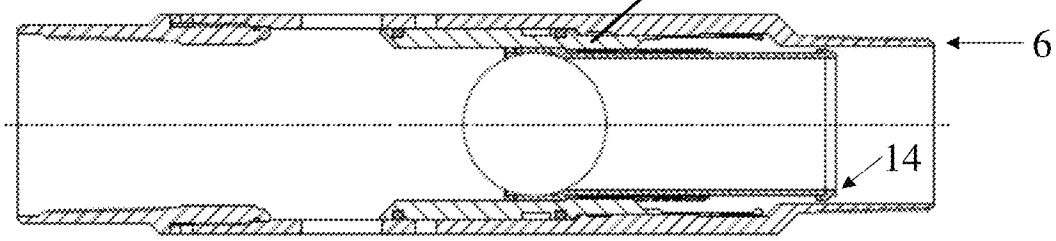
FIG. 5 is a cross sectional elevation view of the frac valve of FIG. 3 with the dart of FIG. 4 and a ball engaged there within, in a frac valve open position.

The mandrel 24 with the restraint surface 52 supporting the upper collet 28 are unable to move further downhole relative the upper collet 28 due to a mandrel shoulder 54 formed on the mandrel 24. At this point the upper collet 28, transfers a compressive force into the sleeve 16 of the frac valve 6 via shoulder 50. When the applied load exceeds the shear valve of the screws 20 holding the sleeve 16 to the frac valve 6, the screws shear permitting the ball 200, dart 14 and sleeve 16 to shift. This action exposes the frac ports 18. The frac sleeve 6 is now open and stimulation fluid can be pumped through the ports 18 and into the formation, as seen in FIG. 5. As also seen in FIG. 5, the ball 200 has also be forced into an expandable uphole portion **24*a* of the mandrel 24 and seats on ball seat 42**.

When the sliding sleeve is being opened and during the frac, the expandable uphole portion **24*a* of the mandrel 24 is radially expanded and contacts an inside bore of the sliding sleeve 16. This action forms a seal between the dart 14 and the sliding sleeve 16; it also transfers compressive load into the sliding sleeve 16, augmenting the contact load between the upper collect 28 and the sliding sleeve shoulder 50. A no-go shoulder formed on an inside surface of the frac valve outer body 44 limits the travel of the sliding sleeve 16 and transfers the force generated during the frac into the outer body 44 of the frac valve 6. The frac valve 6 in turn transfers the load into the liner 2**.

In operation of the present system, in a first step, once the liner 2 is run down the wellbore, the frac valves 6 are isolated by either cementing or by activation of packers 5 or any other means. Applied fluid pressure down the liner causes the toe valve 8 to shift open, exposing ports in the toe valve 8 through which fluids can be pumped into the formation. This allows for fluid flow through the liner 2 and one or more ball 200 and dart 14 pairs can then pumped down the inside of liner 2, since any displaced fluid from pumping can exit through the ports in the toe valve 8, and out to the formation.

The ball 200 and dart 14 travel through each of a predetermined number of frac valves 6 until they reach the frac valve 6 to be opened. This is commonly the frac valve 6 closest to the toe end 10 of the wellbore, but need not necessarily be so. The upper collet 28 in the dart 14 is activated to be fixed in the engaged position by the time it lands on the seat 16 of the frac valve 6 be closed, so that the ball 200 and dart 14 are prevented from travelling through the seat 16 of the desired frac valve 6. As described earlier, pressure begins to increase in the liner 2 uphole of the dart 14 and when the differential pressure across the dart 14 equals the opening pressure of the sleeve 16, the sleeve 16 shifts to the open position, exposing the frac ports 18. The sleeve 16 is commonly pressure balanced until a dart 14 lands on it.

After the first stage is stimulated, a second ball 200 and dart 14 can be pumped from surface. Again, the second ball 200 and dart 14 can travel through any predetermined number of frac valves 6 without opening them, and the indexing sleeve 22 is able to shift into the unengaged position each time. The upper collet 28 will only become fixedly engaged when it lands on restraint surface 52. The upper collet 28 then again abuts against a shoulder 50 on the seat 16. As applied fluid pressure uphole of the ball 200 increases, it shears the screws 20 holding the sleeve 16 in the closed position. The ball 200, dart 14 and sleeve 16 shift exposing frac ports 18.

In this way, while all darts 14 and all frac valves 6 are identical to one another, the initial location of the indexing sleeve along circumferential grooves 32 on the mandrel can be adjusted such that it hits restraint surface 52 and mandrel shoulder 54 after the dart 14 has passed through a predetermined number of frac valves 6.

Each dart 14 can optionally be marked or identified to indicate the frac sleeve 6 it is meant to open. This can aid in ensuring that the darts 14 are deployed in the correct sequence.

Figure 10A:
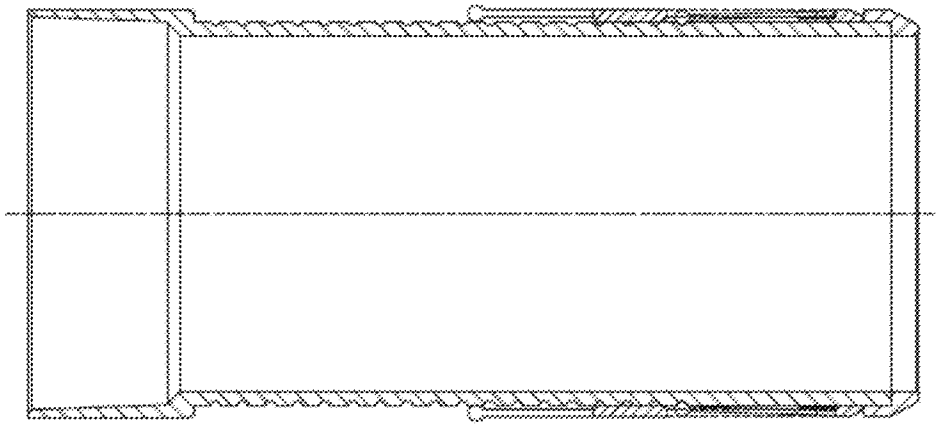
FIG. 10*a* is cross sectional elevation view of a further embodiment of the dart of the present invention, showing a tapered inside diameter of the dart mandrel at the ball seat.

With reference to FIG. 10*a*, in one embodiment, the expandable uphole portion 24*a* of the mandrel 24 has a tapered inside diameter. When the ball 200 wedges into the taper, it expands the portion 24*a* radially outwardly to contact the I.D. of the sliding sleeve 16. The contacting surfaces form a seal and also permit compressive forces to be transferred into the sliding sleeve 16. This embodiment makes allowance for variation in diameters on both the sliding sleeve 16 and the dart mandrel 24.

Figure 10B:
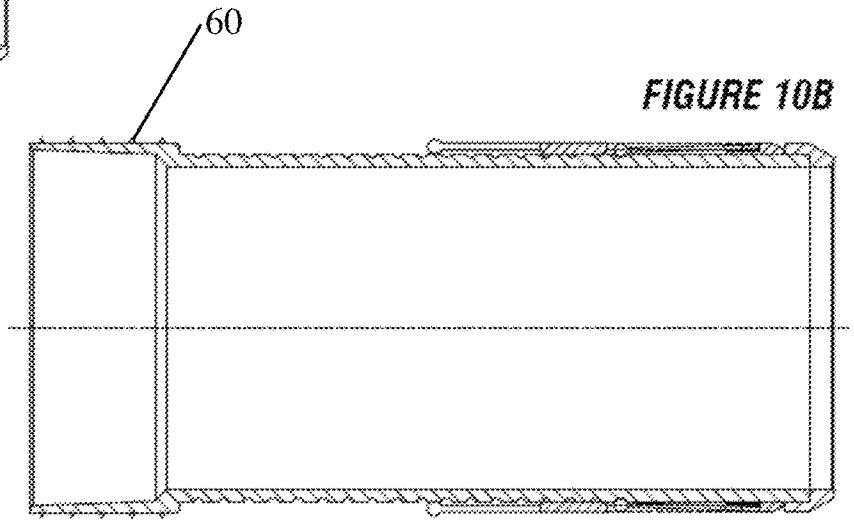
FIG. 10*b* is a cross-sectional elevation view of a further embodiment of a dart of the present invention, showing a series of ridges on the outside diameter of the dart mandrel, at the ball seat.

In another embodiment, depicted in FIG. 10*b*, the expandable uphole portion 24*a* expands radially outwardly to contact the I.D. of the sliding sleeve 16. The series of ridges 60 deform and generate a series of the circumferential seals. The deformed ridges also permit compressive loads to be transferred into the sliding sleeve 16.

Figure 11:
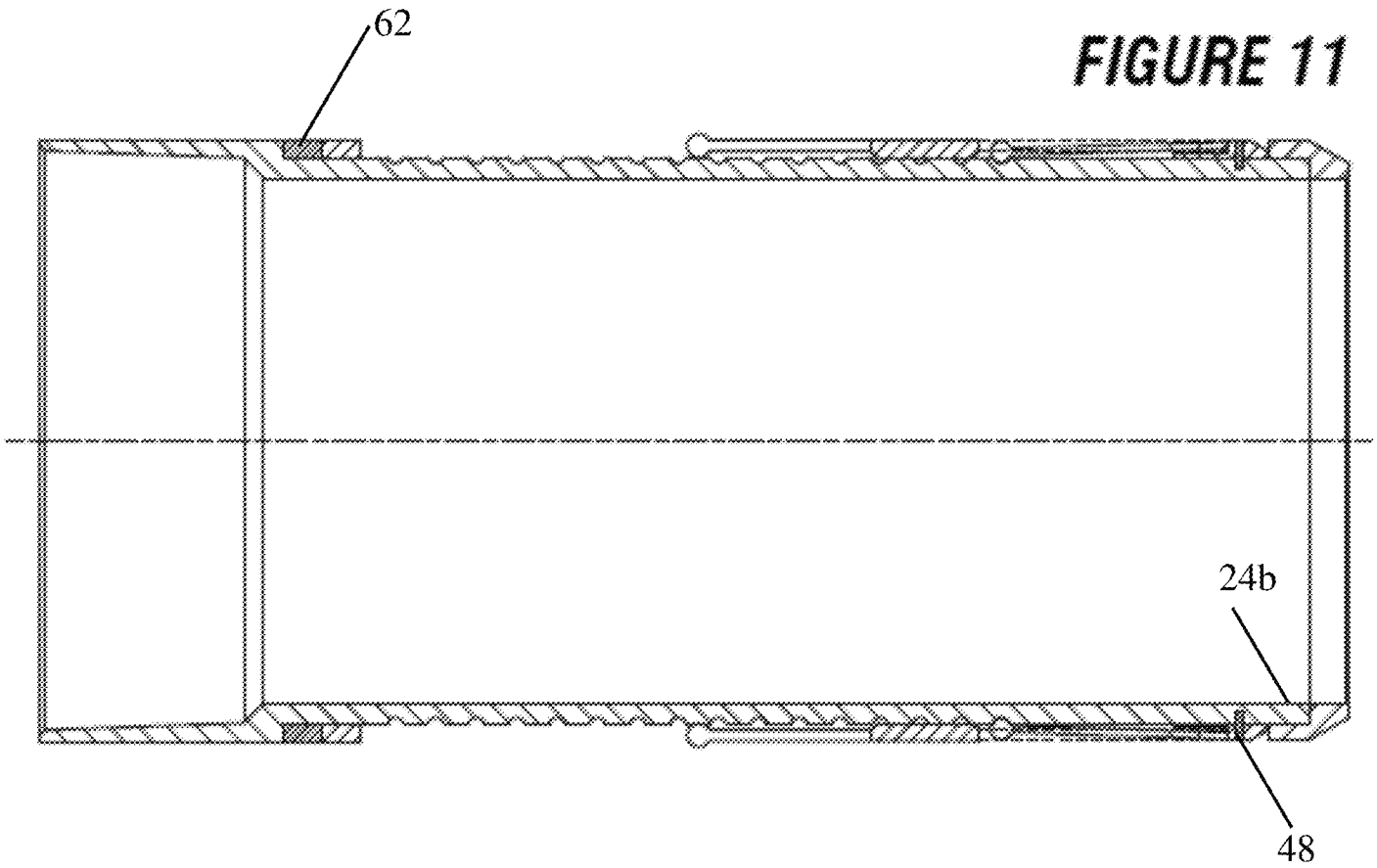
FIG. 11 is a cross sectional elevational view of a further embodiment of the dart, showing an elastomeric ring.

An embodiment that does not rely on expanding the uphole portion 24*a* mandrel 24 is illustrated in FIG. 11. In which a packing element may be used. When the dart 14 lands inside its mating frac sleeve 6, an elastomeric ring 62 trapped between the upper collet 28 on the indexing sleeve 22 and mandrel shoulder 54, expands due to the compressive load being transferred through it. The elastomeric ring 62 forms a seal between the uphole portion 24 of the mandrel 24 and the sliding sleeve 16 inside the frac valve 6.

Regardless of the embodiment used, the seal formed between the dart 14 and the frac valve 6 isolates a thin walled downhole portion 24*b* of the mandrel 24 from collapse pressure during the frac, and from compressive forces that could cause buckling. Both of these features permit the inside diameter of the mandrel 24 to be optimized to the maximum diameter possible thereby giving the largest bore 40 flow area through the mandrel.

Figure 14:
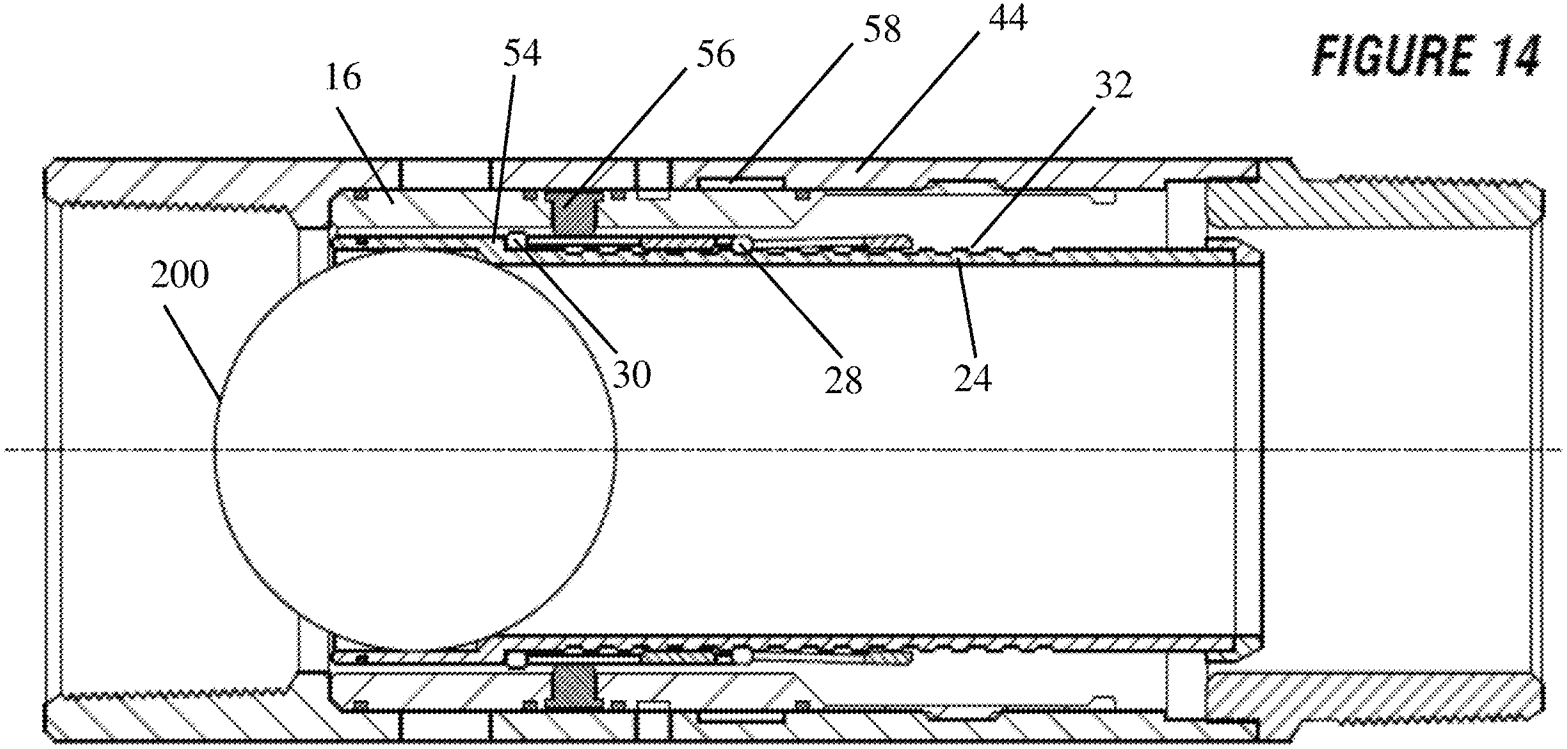
FIG. 14 is a partial cross section view of one embodiment of the frac valve of the present invention, engaged with a dart of the present invention.

Another embodiment of the frac valve 6 and dart 14 is shown in FIG. 14. In this embodiment a single dart 14 is used to open multiple frac valves 6. The sleeve 16 of the frac valve 6 in this embodiment preferably has a temporary no-go shoulder 56 installed thereon. As before, as the dart 14 is pumped through uphole frac valves 6, the indexing sleeve 22 advances incrementally along circumferential groove 32. When the upper collet 28 contacts the restraint surface 52 and mandrel shoulder 54 as shown in FIG. 14, the mandrel 24 of the dart 14 can no longer move further downhole relative to the indexing sleeve 22. Applied pressure generates a force from the upper collet 28 into sleeve 16. This force shears the screws 20 holding the sleeve 16 in place. The ball 200, dart 14 and sleeve 16 shift downhole, exposing the frac ports 18. At this point, the temporary no-go shoulder 56 is aligned with an internal groove 58 formed on an inner surface of the frac valve outer body 44. The radially outwardly engaged upper collet 28 pushes the temporary no-go-shoulder 56 radially outwardly into the groove 58, thereby moving the temporary no-go-shoulder 56 out of the way such that it is no longer an obstacle. The dart 14 can now be pumped through the frac valve 6 and downhole until it lands on the next frac valve 6, where the process is repeated. Multiple frac valves 6 containing the temporary no-go shoulder 56 may be installed and be opened by a single dart 14. In this way, frac valves 6 along the liner 2 are opened generally from a heel 12 to toe 10 direction.

It should be noted that the indexing sleeve 22 in the dart 14 of embodiment of FIG. 14 can still also be initially set to pass through one or more frac valves of the style of FIG. 3 or FIGS. 5 to 9, and then eventually engage, open and pass through one or more frac valves 6 such as those of FIG. 14.

In certain sections of the well, as illustrated in FIGS. 5 to 9, frac valves 6 that open with a specific dart 14 may be used. In other segments of the same well it may be preferable to stimulate by opening a sequence of frac valves 6 with a single dart 14, as in FIG. 14. When opening with the single dart 14, the first frac valve 6 in the sequence to be opened will commonly be closest to the heel end 12 and the last frac valve 6 in the sequence to be opened will commonly be closest to the toe end 10. Once opened, the frac valves 6 can be stimulated through simultaneously.

When all of the desired the frac valves 6 in the liner 2 have been opened and stimulated through, fluids from the formation can now be produced and flow into the well and into the liner 2 through the ports 18. The balls 200 are lifted off their seats by this reverse fluid flow.

The ball can be manufactured from various materials, including phenolic, steel, aluminum or dissolvable composite. The mandrel can be manufactured from steel, aluminum or dissolvable composite. In a preferred embodiment, it is possible to construct both the ball 200 and dart 14 from a dissolvable material. In such cases, this eliminates the need to remove the dart 14 from the well. If the balls 200 are dissolvable, production flows through the large ID darts 14 and the darts 14 can stay in place. If the balls 200 are not dissolvable, dart flow back, as described below, occurs to flow the balls 200, which push against a downhole end of their respective upstream darts 14, and darts 14 uphole.

In a further option, an intervention tool can be run on coil tubing or pipe and can be used to either close or re-open frac valves 6 in the system. If a particular segment of the wellbore started to produce water for example, the adjacent frac valve 6 could be closed. If there was a desire to be able to return and re-frac a particular segment of the formation, frac valves 6 in that area that had previously been opened could be closed using an intervention tool. If a re-frac is desired, then the present system of frac valves 6 and darts 14 allow for the frac valves 6 to be opened or closed or re-opened at will. The intervention tool can be used if the ball 200 has dissolved and the dart 14 is still in place in the frac valve, in the case when a ball 200 and dart 14 have been flowed back to surface, or in the case if the ball 200 and the dart 14 have both dissolved.

Frac valves 6 that had been originally installed during the well construction process and had never been previously opened can now be opened using the present dart 14, as it can be adjust to pass through any number of frac valves 6 uphole of the frac valve to be opened, without engaging or getting caught on any of the uphole frac valves 6. Placement and arrangement of frac valves 6, of either the style of FIG. 3 or FIG. 14, is limitless. The present system provides an operator with full control over the stimulation and production operations of all stages of the wellbore. Since frac valves 6 can be opened, closed and reopened in any order, the operator is provided with an innovative flexibility.

The darts 14 can be flowed back to the surface when the frac job is complete and the well is being produced. In this embodiment a ball from a downstream dart 14, travels upstream with flow of production fluid to rest on a downstream end of the mandrel 24 of an upstream dart 14, thereby blocking flow through the inner bore 40 of the mandrel 24. Pressure acting on a downhole end of the mandrel 24 and causes the indexing sleeve 22 to travel in reverse every time the dart 14 travelled upstream and passed through an upstream frac valve 16. If nitrogen had been pumped during the frac, the nitrogen would assist in flowing the dart 14 back to the surface. Formation fluid or frac fluids would also assist in this process. If the ball 200 is manufactured from a dissolvable material, this can be beneficial if by chance the dart 14 became stuck at any point during flow back.

Figure 12:
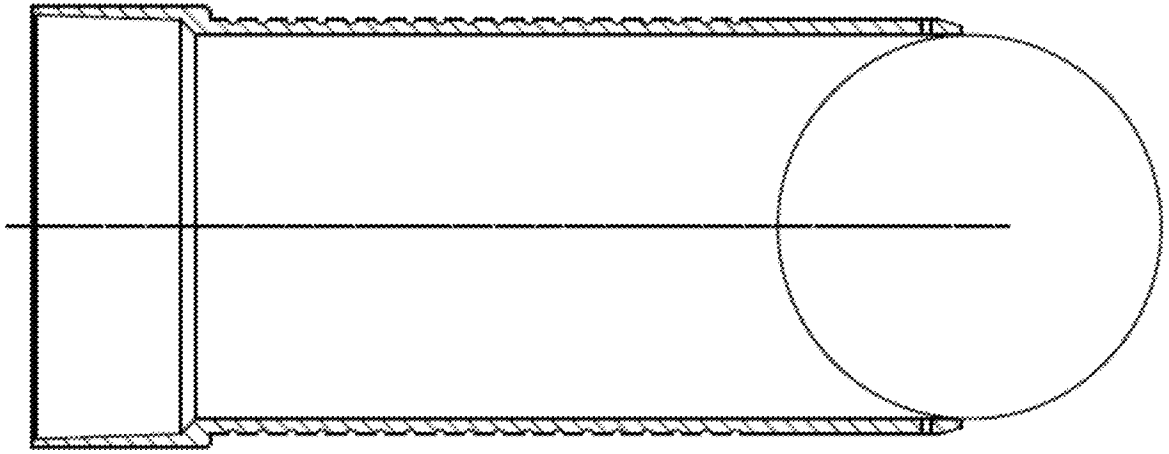
FIG. 12 is a cross sectional elevational view of a further embodiment of the dart, showing a flow back feature.

With reference to FIG. 12, in an optional embodiment of the present dart 14, a hole 64 located in the mandrel 24 of the dart 14 can provide communication between the outer surface of the mandrel and inner surface of the mandrel. This permits fluid to flow past the dart in the event of a screen out. For the purposes of the present description, a screen out is a condition that occurs when the solids carried in a treatment fluid, such as proppant in a fracture fluid, cause a restricted flow area. This creates a sudden and significant restriction to fluid flow that causes a rapid rise in pump pressure.

Hole 64 also allows production fluids to flow to surface in the case of the use of balls 200 that are not dissolvable. The ball 200 from the downhole dart 14 would flow back and land against the lower end of the dart 14 located uphole. The hole 64in the mandrel 24 would permit fluid to by-pass around the ball 200 and flow back to the surface. This feature can also be used on darts with a lock in place mechanism.

Figure 13:
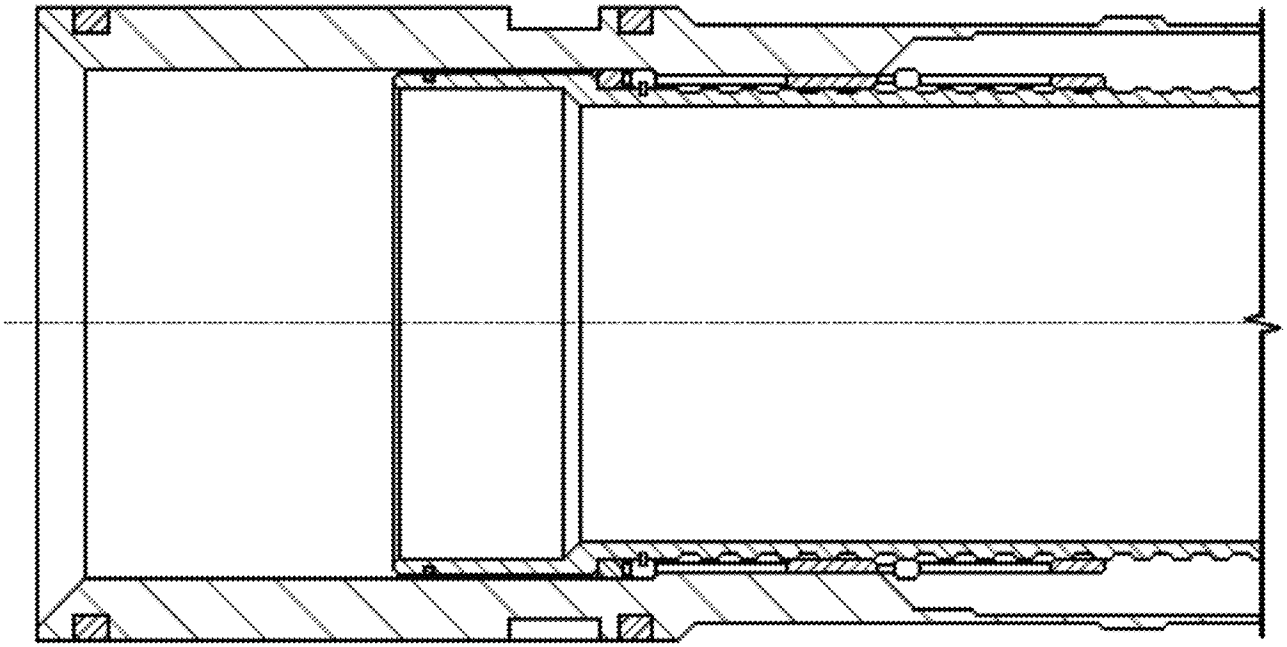
FIG. 13 is a partial cross section view of one embodiment of the dart of the present invention engaged in one embodiment of the frac valve of the present invention.

With reference to FIG. 13, this embodiment provides a mechanism by which the indexing sleeve 22 can be locked in place in the engaged position on the mandrel 24. In this embodiment, the restraint surface 52 may be somewhat elongated such that when the dart 14 lands in its required frac valve, the indexing sleeve 22 continues to move relative to the mandrel 24 to shift the lower collet 30 also into the radially outwardly extended position, similar to the upper collet 28. A snap ring 66 formed on the restraint surface would then snap into a groove 68 formed on an mating surface of the upper collet 28, thus locking the indexing sleeve 22 in place relative to the mandrel 24. In other embodiments, not shown, any suitable means of preventing any axial movement of upper collet 28 and indexing sleeve 22 relative to the mandrel 24 would also serve as a locking mechanism, while maintaining the lower collet 30 in a radially outwardly expressed position. For example, engaging upper collet 28 against a further shoulder on the mandrel 24 to prevent relative movement of the mandrel 24 relative the indexing sleeve 22 would also be suitable and is encompassed by the scope of the present invention.

With reference to FIG. 11, in a further embodiment, a shear pin 48 located between the indexing sleeve 22 and mandrel 24 prevents pre-mature movement of the indexing sleeve 22 relative to the mandrel 24. The shear pin 48 shears whenever the dart 14 reaches the first frac valve 6 in the liner.

The process described previously, introduces a novel method for well design and construction. It provides the operator with multiple options for completing the wellbore and also for the stages of stimulating and producing. The well may be completed with frac valves 6 that open independently from each other with individual darts 14 (as in the case of the frac valves 6 of FIG. 3). The well also may be completed with frac valves 6 that open in conjunction with other frac valves 6 using a single dart 14 (as in the case of the frac valves 6 of FIG. 14). Alternatively both types of frac valves 6 can be used in the same liner 2 and be ordered in any configuration. Since each dart 14 is set to open particular valves and valve types, no valves can be prematurely opened by a dart 14. Frac valves 6 may be opened for fracking and stimulation before initial production of the formation. After a given period of time, frac valves 6 that had not been previously been opened for fracking or stimulating can be opened and the formation can then be stimulated through them.

The present systems and tools introduce novel aspects to frac valve and dart construction as well as to stimulation and production operations. In the present invention a single dart 14 can be used to open one frac valve 6 or multiple frac valves 6. A dart 14 can be adjusted to open a specific frac valve 6, or combination of frac valves 6. The innovative timing mechanism of the dart 14 permits the dart 14 to be set-up to travel through a desired number of frac valves and then engage and open a specific frac valve 6 or series of frac valves 6.

The method and systems described herein permit access to an un-restricted near full bore well I.D. since the darts 14 are pumped down the well and not run on an intervention tool or other tubing deployed system that can restrict the ID of the liner 2. Intervention tools can be used with the system to close, open or re-open specific or multiple frac valves at the operator's discretion.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A system run on a liner for stimulating one or more stages of a downhole wellbore, said system comprising:

a. one or more frac valves arranged on the liner, said frac valves each comprising a shiftable sleeve being openable for providing fluid communication between within the liner to outside of the liner;

b. an at least one dart deployable into the liner, and being configured to pass through an at least one of the one or more frac valves without opening the sleeve of said at least one of the one or more frac valves, and to subsequently engage and open an another of the one or more other frac valves, wherein the at least one dart comprises an adjustment mechanism being adjustable from one or more first positions that allow passage of the dart through the at least one of the one or more frac valves without opening, to a second position that facilitates engagement of the dart with the another of the one or more other frac valves, the adjustment mechanism further comprising:

an indexing sleeve, moveably mounted to an outside diameter of a mandrel of the dart, to control movement of the dart from the one or more first positions to the second position;

an upper collet and a lower collet formed on the indexing sleeve, said upper and lower collet being biased radially inwardly towards the mandrel;

a series of circumferential grooves formed on an outer surface of the mandrel of the dart, such that the upper and lower collet of the indexing sleeve are engagable by said circumferential grooves as the indexing sleeve travels axially relative the mandrel, to either allow the upper collet or the lower collet to retract radially into a groove or to be radially extended in between said grooves;

a restraint surface formed at an uphole end of the mandrel, that serves to radially extend said upper collet when the indexing sleeve is at the second position; and a mandrel shoulder formed at an uphole end of the mandrel, to stop axial movement of the indexing sleeve at the second position.

2. The system of claim 1, wherein the mandrel is shiftable relative to the indexing sleeve to shift the upper collet and lower collet from a collet engaged position to a collet unengaged position.

3. The system of claim 2, wherein, when the at least one dart is engaged in the another frac valve, the at least one dart is sealable against an inside diameter of the another frac valve to isolate a downhole end of the mandrel from collapse pressure.

4. The system of claim 3, wherein an uphole portion of the mandrel comprises a packing element on its outer diameter, between the upper collet and the mandrel, said packing element being radially expandable to form a seal between the at least one dart and the inside diameter of the another frac valve.

5. The system of claim 2, wherein the at least one dart further comprises an uphole portion of the mandrel that is radially expandable to contact an inside diameter of the another frac valve and form a seal.

6. The system of claim 5, wherein the radially expandable uphole portion of the mandrel has a tapered inside diameter.

7. The system of claim 5, further comprising one or more ridges formed on an outside diameter of the radially expandable uphole portion of the mandrel, said ridges being deformable to form a series of seals when the at least one dart is sealable against the inside diameter of the another frac valve.

8. The system of claim 1, further comprising a cap on a downhole end of the mandrel to limit downhole movement of the indexing sleeve.

9. The system of claim 1, wherein the another dart comprises a bore through the mandrel to provide passage of production fluid.

10. The system of claim 1, wherein the dart further comprises ball seatable on an uphole end of the dart to block a bore through the mandrel.

11. The system of claim 10, wherein the ball and the dart are made from a dissolvable material.

12. The system of claim 1, further comprising a cap on a downhole end of the mandrel, wherein the indexing sleeve is settable to a predetermined distance from the cap in order to pair the at least one dart with the another frac valve.

13. The system of claim 1, wherein the at least one dart is flowable back upstream by movement of the indexing sleeve along the mandrel to allow the at least one dart to pass upstream through the at least one of the one or more frac sleeves.

14. The system of claim 1, wherein the mandrel further comprises a hole formed therein to provide communication between an outer surface and an inner surface of the mandrel.

15. The system of claim 1, wherein the restraint surface further comprises a snap ring engagable into a groove formed on a mating surface of the upper collet to thus lock the indexing sleeve in the engaged position.

16. The system of claim 1, wherein the at least one of the one or more frac valves is engageable by a second dart.

17. The system of claim 1, wherein the another of the one or more frac valves further comprises a temporary no-go shoulder formed on the sleeve, and a groove for receiving the temporary no-go shoulder when the shiftable sleeve is shifted to a frac valve opened position, thus allowing passage of the at least one dart through the another frac valve after the another frac valve has been opened.

18. A method for stimulating a subterranean formation, said method comprising the steps of:

a. running a liner down into a wellbore, the liner comprising a first frac valve, and a second frac valve positioned downhole from the first frac valve, each of first and second frac valves presenting an identical inside profile and having a sleeve being openable to prove fluid communication between an inside of the liner to an outside of the liner;

b. pumping an at least one dart down into the liner, c. passing said at least one dart through the first frac valve without opening it; and d. after passing through the first frac valve, engaging said at least one dart within and opening the sleeve of the second frac valve, wherein said at least one dart comprises an adjustment mechanism being adjustable from a first position that allows passage of the dart through the first frac valve without opening it, to a second position that facilitates engagement of the dart with the second frac valve, the adjustment mechanism further comprising:

a mandrel;

an indexing sleeve disposed along the mandrel, the indexing sleeve configured to control movement of the dart from the first position to the second position;

an upper collet and a lower collet formed on the indexing sleeve, said upper and lower collet being biased radially inwardly towards the mandrel;

a series of circumferential grooves formed on an outer surface of the mandrel, whereby the upper and lower collet of the indexing sleeve are engagable by said circumferential grooves as the indexing sleeve travels axially relative the mandrel, to either allow the upper collet or the lower collet to retract radially into a respective groove or to be radially extended in between respective adjacent grooves;

a restraint surface formed at an uphole end of the mandrel, that serves to radially extend said upper collet when the indexing sleeve is at the second position; and a mandrel shoulder formed at an uphole end of the mandrel, to stop axial movement of the indexing sleeve at the second position.

19. A system for stimulating a subterranean formation, the system comprising:

a wellbore formed within the subterranean formation;

a tubular disposed within the wellbore;

a first frac valve disposed within the tubular, the first frac valve having a first sleeve being openable for providing fluid communication between within the tubular to outside of the tubular;

a second frac valve disposed within the tubular downhole from the first frac valve, the second frac valve having a second sleeve being openable for providing fluid communication between within the tubular to outside of the tubular;

a dart deployable into the tubular, and being configured to pass through the first frac valve without opening the first sleeve, and to subsequently engage the second frac valve, and open the second sleeve, wherein the dart comprises an adjustment mechanism being adjustable from a first position that allows the dart to pass through the first frac valve, to a second position that facilitates engagement of the dart with the second frac valve, the adjustment mechanism further comprising:

a mandrel comprising an outer surface;

an indexing sleeve moveably disposed on the outer surface, the indexing sleeve configured to control movement of the dart from the first position to the second position;

an upper collet and a lower collet formed on the indexing sleeve;

a series of grooves formed on the outer surface, such that the upper and lower collet of the indexing sleeve are engagable by respective grooves as the indexing sleeve travels axially relative the mandrel;

a restraint surface formed at an uphole end of the mandrel, that serves to radially extend the upper collet when the indexing sleeve is at the second position; and a mandrel shoulder formed at the uphole end of the mandrel.

20. The system of claim 19, wherein the mandrel is shiftable relative to the indexing sleeve to shift the upper collet and lower collet from a collet engaged position to a collet unengaged position.

21. The system of claim 19, wherein when the at least one dart is engaged in the second frac valve, the at least one dart is sealable against an inside diameter of the second frac valve.

22. The system of claim 19, wherein the at least one dart further comprises an uphole portion of the mandrel that is radially expandable to contact an inside diameter of the second frac valve.

23. The system of claim 19, the at least one dart further comprising a cap on a downhole end of the mandrel to limit downhole movement of the indexing sleeve, and wherein the at least one dart comprises a bore.

24. The system of claim 19, wherein the mandrel further comprises a lateral hole formed therein, and wherein a snap ring is engagable into a groove formed on a mating surface of the upper collet to thus lock the indexing sleeve in the engaged position.

* * * * *